US009821483B2

(12) United States Patent
Colburn et al.

(10) Patent No.: US 9,821,483 B2
(45) Date of Patent: Nov. 21, 2017

(54) MANDOLINE-TYPE FOOD SLICER

(71) Applicant: Helen of Troy Limited, Belleville, St. Michael (BB)

(72) Inventors: Eric Richard Colburn, Wexford, PA (US); Hyuk Jae Chang, Pittsburgh, PA (US); Mackenzie Mor, New York, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 36 days.

(21) Appl. No.: 15/202,779

(22) Filed: Jul. 6, 2016

(65) Prior Publication Data

US 2017/0021515 A1 Jan. 26, 2017

Related U.S. Application Data

(60) Provisional application No. 62/196,533, filed on Jul. 24, 2015.

(51) Int. Cl.
*B26D 3/28* (2006.01)

(52) U.S. Cl.
CPC ..... *B26D 3/283* (2013.01); *B26D 2003/286* (2013.01); *B26D 2210/02* (2013.01)

(58) Field of Classification Search
None
See application file for complete search history.

(56) References Cited

U.S. PATENT DOCUMENTS 4,573,387 A 3/1986 Denter et al.
4,733,588 A 3/1988 Yamamoto
6,082,645 A 7/2000 Himmighofen et al.
7,066,071 B2 6/2006 Zeder et al.
7,143,677 B2 12/2006 Zeder et al.
7,621,207 B2 * 11/2009 Botsai ..... B26D 3/283 30/278
7,694,615 B2 4/2010 DiPietro
8,069,766 B2 * 12/2011 de Buyer ..... A47J 43/25 83/648
8,151,678 B2 4/2012 Mah et al.
8,181,560 B2 5/2012 Hauser et al.
8,430,010 B2 4/2013 Holmes et al.
8,438,961 B2 * 5/2013 Repac ..... B26D 3/283 83/440.2
8,839,702 B2 * 9/2014 Bagley ..... B26D 3/283 83/425.3

(Continued)

OTHER PUBLICATIONS

International Search report dated Sep. 26, 2016.

*Primary Examiner* — Kenneth E. Peterson
*Assistant Examiner* — John E Grosselin, III
(74) *Attorney, Agent, or Firm* — Rankin, Hill & Clark LLP

(57) ABSTRACT

A food slicer includes a frame for supporting a landing and a runway, which is movable relative to the landing. A cutting blade is secured on an upstream end of the landing. A separate cutting knife is moveably connected to the frame. An adjustment mechanism is connected to the frame to adjust an offset between the cutting blade and the runway. The adjustment mechanism includes first and second guide tracks provided on respective first and second movable cam plates, and a gear mechanism for moving the first and second cam plates along a length direction of the food slicer.

20 Claims, 12 Drawing Sheets

(56) References Cited

U.S. PATENT DOCUMENTS

| | | | | |
|---|---|---|---|---|
| 8,919,234 | B2 * | 12/2014 | Aby-Eva | B26D 3/283 83/440.2 |
| 2004/0200366 | A1 | 10/2004 | Koerselmann et al. | |
| 2004/0231482 | A1 | 11/2004 | Boilen | |
| 2005/0061124 | A1 | 3/2005 | Vincent | |
| 2006/0075872 | A1 | 4/2006 | Wangler | |
| 2006/0081108 | A1 | 4/2006 | de Buyer | |
| 2006/0123639 | A1 | 6/2006 | Boerner | |
| 2006/0261196 | A1 * | 11/2006 | Klotz | A47J 43/25 241/95 |
| 2006/0283299 | A1 | 12/2006 | Mellen et al. | |
| 2007/0062349 | A1 | 3/2007 | Ishii | |
| 2007/0089577 | A1 | 4/2007 | Wong | |
| 2007/0137457 | A1 | 6/2007 | Botsai et al. | |
| 2008/0098866 | A1 | 5/2008 | DiPietro | |
| 2008/0257128 | A1 | 10/2008 | Reimann et al. | |
| 2008/0308661 | A1 * | 12/2008 | Mah | A47J 43/082 241/94 |
| 2009/0123623 | A1 | 5/2009 | Tweg | |
| 2009/0133587 | A1 * | 5/2009 | de Buyer | A47J 43/25 99/537 |
| 2009/0255391 | A1 | 10/2009 | Hood et al. | |
| 2010/0122465 | A1 * | 5/2010 | Holmes | A47J 43/25 30/275.4 |
| 2010/0162869 | A1 | 7/2010 | Smith et al. | |
| 2011/0067545 | A1 | 3/2011 | Robbins | |
| 2011/0120279 | A1 | 5/2011 | Braun | |
| 2011/0132161 | A1 | 6/2011 | Robbins | |
| 2012/0198980 | A1 | 8/2012 | Bagley | |
| 2012/0227564 | A1 * | 9/2012 | Fung | A47J 43/25 83/856 |
| 2013/0087033 | A1 | 4/2013 | Tetreault | |
| 2013/0232800 | A1 * | 9/2013 | Holmes | A47J 43/25 30/286 |
| 2014/0208916 | A1 | 7/2014 | Aby-Eva | |
| 2015/0231791 | A1 * | 8/2015 | Robbins | B26D 3/283 83/564 |
| 2015/0246457 | A1 * | 9/2015 | Wong | B26B 3/03 30/279.6 |

* cited by examiner

MANDOLINE-TYPE FOOD SLICER

BACKGROUND

Food slicers of a type known as mandoline slicers are well known and very popular for slicing and cutting raw and cooked food items in various shapes, thicknesses and forms. Mandoline slicers have a blade having a blade body and a leading blade edge on the blade body for cutting food. Mandoline slicers also generally include an infeed deck or runway having a support surface spaced from an outfeed deck or landing having the cutting blade. The slicer is operated by directing a quantity of food in a direction toward the blade edge to be cut. A bulk quantity of food is typically placed on the support surface of the runway, and then slid across the runway toward the blade edge. The blade is offset from the runway, and the offset distance provides a thickness or depth of the cut made in the food as it is pushed into the blade. After the food passes by the blade, the uncut portion passes above the blade and onto a landing, and the sliced portion passes below the blade and separates from the rest of the food bulk.

In order to select a slice thickness, some mandoline slicers are adjustable. That is, the slicer is adjustable so that the offset between the blade and the runway may be selected. In the prior art, several techniques are employed to vary the spacing between the item feeding surface and the blade edge to control the thickness of the cut. Each of these techniques has its limitations.

BRIEF DESCRIPTION

In accordance with one aspect, a mandoline-type food slicer for slicing food advanced in a cutting direction comprises a frame for supporting a landing and a runway, which is movable relative to the landing. A cutting blade is secured on an upstream end of the landing. A downstream end of the runway is spaced from an edge of the cutting blade to define an opening for the passage of sliced food. A separate cutting knife is moveably connected to the frame. An adjustment mechanism is connected to the frame and configured to adjust an offset between the cutting blade and the runway. The adjustment mechanism includes spaced apart first and second guide tracks provided on respective first and second movable cam plates, and a gear mechanism for moving the first and second cam plates along a length direction of the food slicer. The adjustment mechanism simultaneously engages the runway and the cutting knife, the first guide tracks cooperating with the downstream end of the runway and the second guide tracks cooperating with the cutting knife. The first and second guide tracks are configured such that a first movement of the adjustment mechanism from a locked position of the food slicer to a cutting position lowers the downstream end of the runway relative to the cutting blade to adjust a cutting thickness and a second movement of the adjustment mechanism from the cutting position raises the cutting knife to a working position.

In accordance with another aspect, a mandoline-type food slicer for slicing food advanced in a cutting direction comprises a frame for supporting a landing and a runway, which is movable relative to the landing. A cutting blade is secured on an upstream end of the landing. A downstream end of the runway is spaced from an edge of the cutting blade to define an opening for the passage of sliced food. A separate cutting knife is moveably connected to the frame. An adjustment mechanism is connected to the frame and configured to adjust an offset between the cutting blade and the runway.

The adjustment mechanism includes spaced apart first and second guide tracks provided on respective first and second cam plates, the first guide tracks cooperating with the downstream end of the runway and the second guide tracks cooperating with the cutting knife, and a gear mechanism for moving the first and second cam plates along a length direction of the food slicer. The gear mechanism includes a first pinion gear meshingly engaged to a first rack connected to the first side member, a second pinion gear meshingly engaged to a second rack connected to the second side member, a shaft interconnecting the first and second pinions gears, and a knob connected to an end portion of the shaft extending outwardly from the frame.

DETAILED DESCRIPTION

It should be understood that the description and drawings herein are merely illustrative and that various modifications and changes can be made in the structures disclosed without departing from the present disclosure. In general, the figures of the exemplary mandoline-type food slicer are not to scale. It should be appreciated that the term "plurality" means "two or more", unless expressly specified otherwise. For the sake of description, terms used herein such as the term downstream refers to the direction in which food is moved for cutting, and the term upstream refers to a direction opposite to the direction for cutting the food bulk. The thickness is the thickness of the slice of the food bulk made by the food slicer. It will also be appreciated that the various identified components of the exemplary mandoline-type food slicer disclosed herein are merely terms of art that may vary from one manufacturer to another and should not be deemed to limit the present disclosure.

Figure 1:
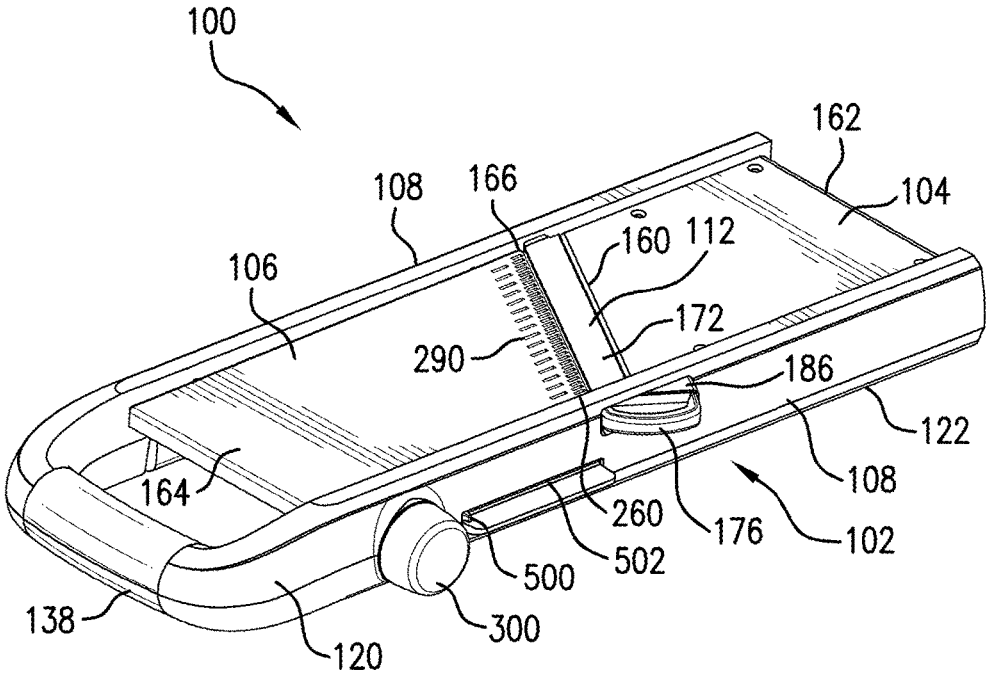
FIG. 1 is a side perspective view of an exemplary mandoline-type food slicer according to one aspect of the present disclosure.
Figure 2:
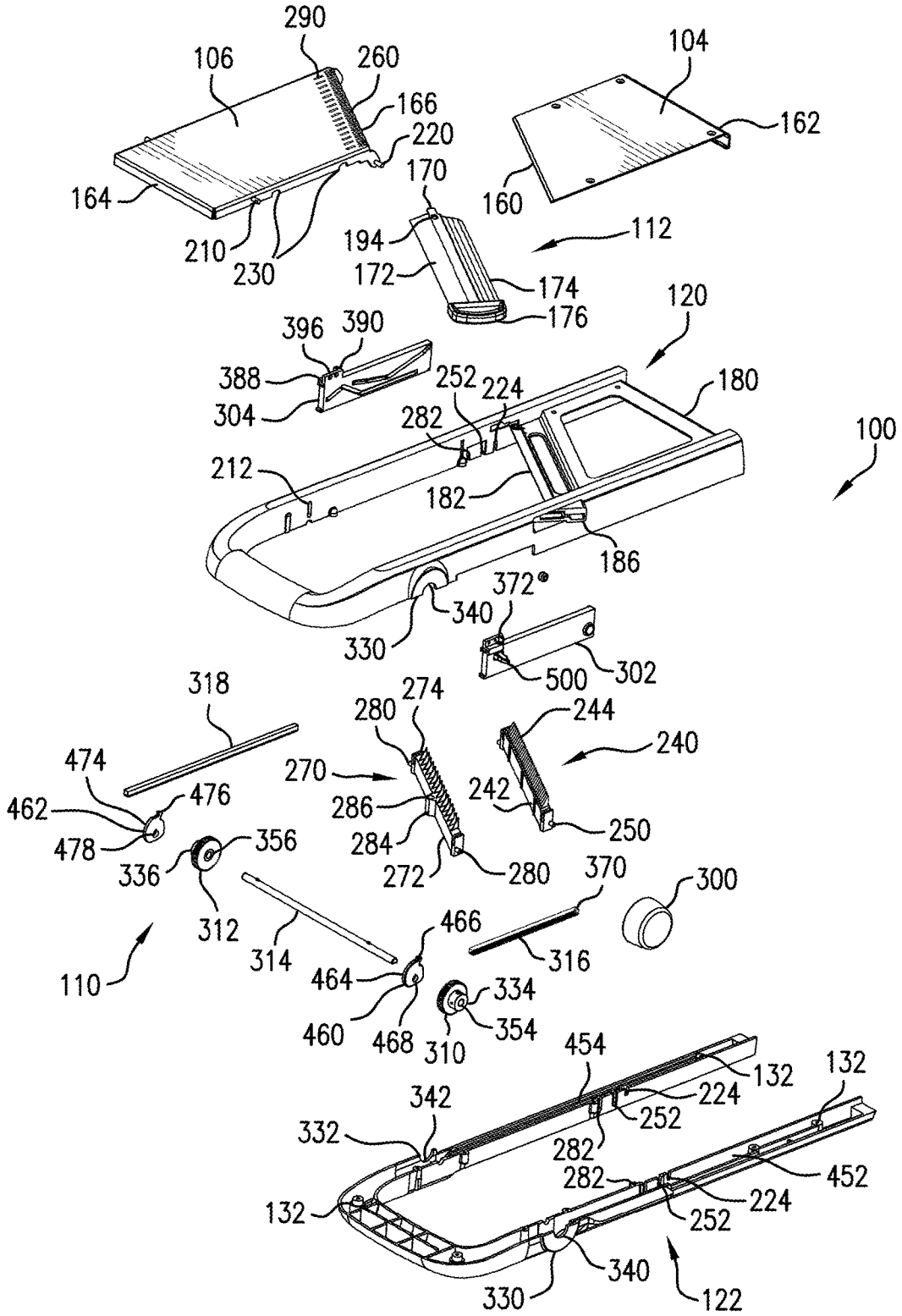
FIG. 2 is an exploded perspective view of the food slicer of FIG. 1.

Referring now to the drawings, wherein like numerals refer to like parts throughout the several views, FIGS. 1 and 2 illustrate an exemplary mandoline-type food slicer 100 according to one aspect of the present disclosure for slicing food advanced in a downstream cutting direction. The food slicer 100 includes a frame 102 for supporting an outfeed deck or landing 104 and an infeed deck or runway 106 between longitudinal sides 108 of the frame. The runway 106 is movable relative to the landing 104 by an adjustment mechanism 110 so that a thickness of a slice of food made by the food slicer 100 can be selected. A cutting blade 112 is secured to the landing 104. During operation, a food bulk to be sliced is placed on a substantially planar surface of the runway 106 and advanced toward the cutting blade 112. As a portion of the food bulk comes into contact with the cutting blade 112, the cutting blade begins to cut into the food bulk to form a slice. Once the entire food bulk is moved past the cutting blade, the slice is separated from the food bulk and passes through an opening underneath the cutting blade 112. To enable this operation, a blade edge of the cutting blade 112 is positioned above the runway 106 and selection of a slice thickness is made by the adjustment mechanism 110.

Figure 3:
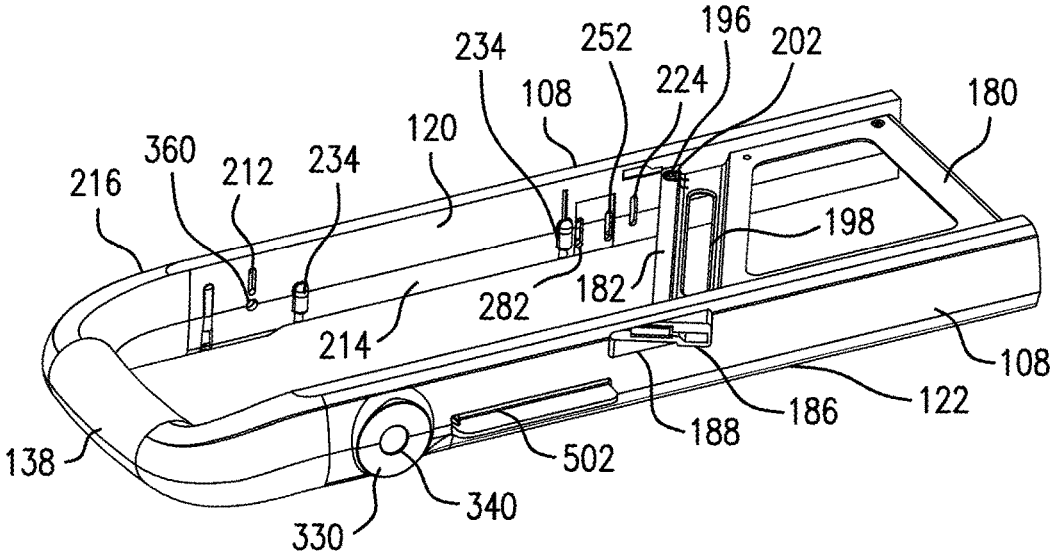
FIG. 3 is a side perspective view of a frame of the food slicer of FIG. 1.
Figure 4:
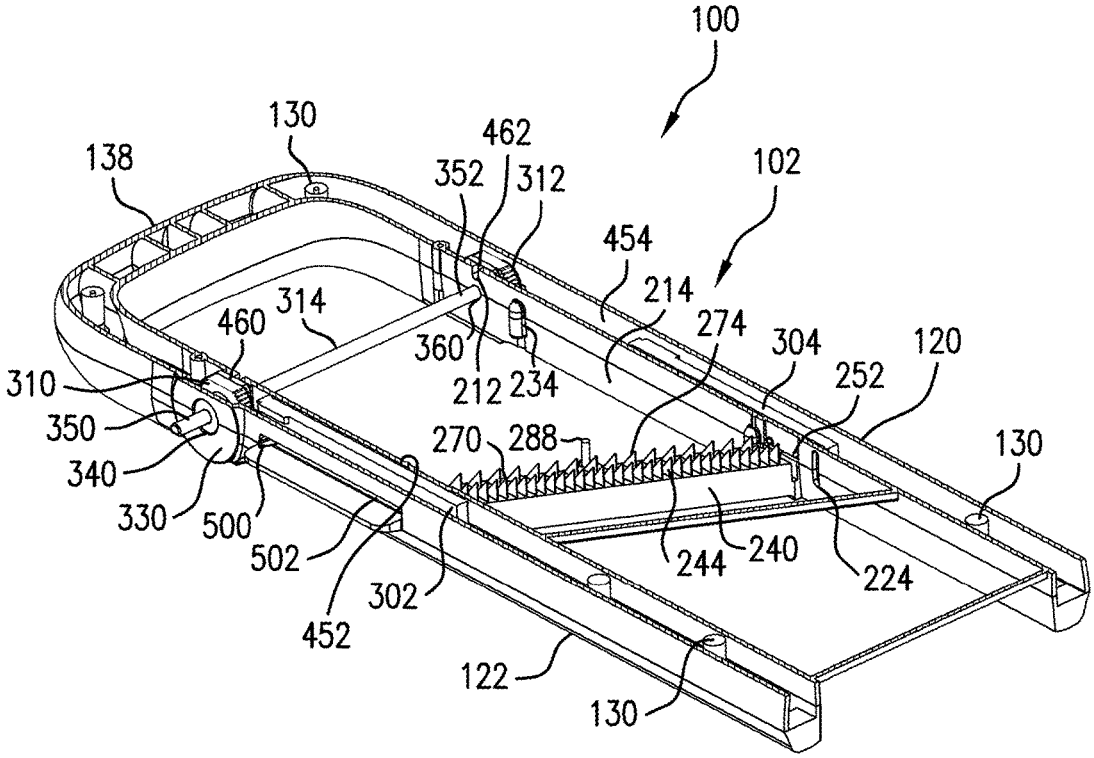
FIG. 4 is a top cross-sectional view of the of the food slicer of FIG. 1.

As shown in FIGS. 2-4, the frame 102 includes an upper part 120 and a lower part 122 secured to the upper part 120 by a plurality of fasteners, such as screws (not shown). The fasteners can extend through a plurality of bosses 130 provided on the lower part 122 and engage corresponding bosses 132 provided on the upper part 120 (FIG. 4). The upper and lower parts 120, 122 of the frame 102 also define a handle 138 for ease of transport as well as for steadying the food slicer 100 during use. Additionally, a stand (not shown) can be pivotally connected to the lower part 122 of the frame 102 so that the frame can be raised during use of the food slicer 100. The landing 104 includes an upstream end 160 and a downstream end 162. Similarly, the runway 106 includes an upstream end 164 and a downstream end 166. The blade 112 is secured on a top side of the upstream end 160 of the landing 104. The downstream end 166 of the runway 106 is spaced or offset from the edge of the cutting blade 112 to define an opening for the passage of sliced food bulk. For safety, the downstream end 166 of the runway 106 can include an elastomeric wing (not shown) configured to fill the space between the runway 106 and landing 104.

The cutting blade 112 includes a body 170 having a first blade part 172 extending along one side and a second blade part 174 extending along an opposite side of the body 170. The first blade part 172 is defined by a single substantially planar member which is substantially co-planar with a top surface of the landing 104. The second blade part 174 is defined by at least two or more vertically stacked and offset substantially planar members, an upper most planar member also being substantially co-planar with the top surface of the landing 104. The cutting blade 112 is configured such that one of the first blade part 172 and second blade part 174 is positioned on the slicer 100 for cutting, and depending on the selected first or second blade part, a handle 176 is secured to one of the ends of the body 170. Particularly, the upper part 120 of the frame 102 includes a first support 180 and a second support 182. The landing 104 is attached to the first support 180 by a plurality of fasteners, such as screws (not shown). The cutting blade 112 is positioned on the second support 182 via a guide member 186 extending through a slot 188 located on one of the side 108 of the frame 102. The body 170 of the cutting blade 112 is slidingly received in the guide member 186 and is supported by the second support 182. Each end of the body 170 includes an alignment hole 194 which receives a pin 196 located on the second support 182 opposite the guide member 186. A seat 198 of the second support 182 is adapted to receive the second blade part 174 in its non-use position. To insert the cutting blade 112 transversely on the slicer 100, the user first selects the first or second blade part 172, 174 to be used for cutting the food bulk and secures the handle 176 to the appropriate end of the body 170. The cutting blade 112 is then inserted through the guide member 186 until the end of the body 170 is received in a cutout 202 located on the opposite side 108 of the frame 102 and the pin 196 is positioned in the alignment hole 194. This further secures the cutting blade 112 to the frame 102.

Both the landing 104 and runway 106 can include upstanding ridges which assist in moving the bulk food along the runway and landing by preventing sticking and an airlock condition during operation. During operation, the food bulk placed on the runway 106 is advanced towards the cutting blade edge. As a portion of the food bulk comes into contact with the blade edge, the cutting blade 112 begins to cut into the food bulk to form a slice. Once the entire food bulk has passed by the blade edge, the slice is completed and is separated from the food bulk by passing underneath the cutting blade 112. To enable this operation, the cutting blade edge is positioned at the offset or thickness above that of the runway 106.

As is well known, the cutting blade 112, despite cutting through the food bulk, provides a resistance force. For example, a straight blade edge that is perpendicular or transverse to the direction of cutting may require a relatively high force applied to the food bulk. The straight blade makes a line contact across a square face of the food bulk, and the entire blade edge enters the food bulk at generally the same time. To ease the entrance of the cutting blade 112 into the food bulk, the blade edge is at an angle from the direction of cutting (i.e., the cutting blade is canted relative to a longitudinal axis defined by the frame 102). This allows a first portion of the cutting blade 112 to enter the food at the oblique angle, and the rest of the cutting blade trails and enters subsequent to the first portion, thus requiring a lower initial force to begin a cut of the bulk food.

As indicated previously, the runway 106 is movably connected to the frame 102. With particular reference to FIGS. 2 and 3, the upstream end 164 of the runway 106 includes pivot stubs or projections 210 located on its outwardly facing sides. The upper part 120 of the frame 102 includes elongated or slotted (in the vertical direction) openings 212 located on inwardly facing surfaces 214 of the sides 108 proximate an upstream end 216 of the frame 102. The openings 212 are sized to slidably receive the pivot stubs 210 as the runway 106 is moved via the adjustment mechanism 110 to adjust a thickness of the sliced food bulk. Further, the downstream end 166 of the runway includes pivot stubs or projections 220 located on its outwardly facing sides. The inwardly facing surfaces 214 of the frame sides 108 proximate the upstream end 160 of the landing 104 includes elongated or slotted (in the vertical direction) openings 224 sized to receive the pivot stubs 220. The pivot stubs 220 are also movable in the openings 224 as the runway 106 is moved via the adjustment mechanism 110. Further, as will be described in greater detail below, the adjustment mechanism 110 is operable to move the runway 106 in a vertical direction between a raised position (FIG. 1) and a lowered position (not shown) where the entirety of the runway 106 is vertically offset from both the cutting blade 112 and the landing 104. In the lowered position of the runway cutouts 230 on the outwardly facing sides of the runway 106 receive correspondingly shaped projections 234 located on the inwardly facing surfaces 214 of the frame sides 108, which further stabilizes the runway 106 in the lowered position on the frame 102.

Figure 7:
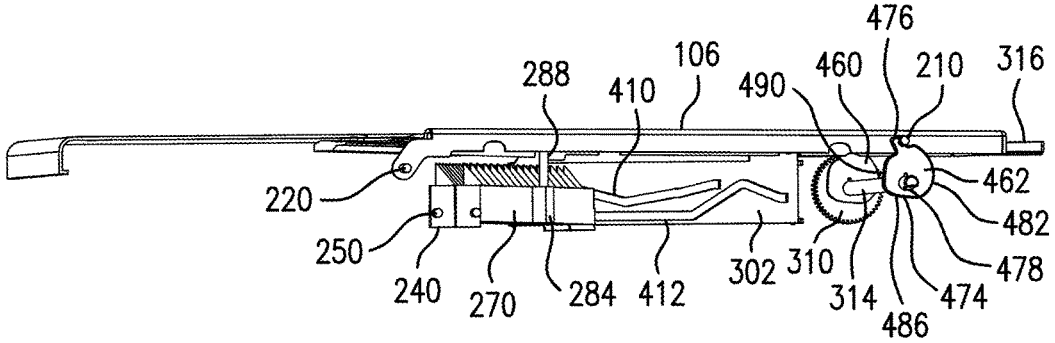
FIG. 7 is a cross-sectional view of FIG. 6.

With reference again to FIG. 2, a first cutting knife 240 can be movably connected to the frame 102. In the illustrated embodiment, the first cutting knife 240 is a julienne cutting knife including an elongated bar 242 and a plurality of vertically standing julienne blades 244 attached to and extending upwardly from the bar 242. To connect the first cutting knife 240 to the frame 102, extending outwardly from opposite ends of the bar 242 are projections 250. The projections 250 are displaceable in elongated or slotted (in the vertical direction) openings 252 located on the inwardly facing surfaces 214 of the frame sides 108 (FIG. 3). According to the depicted embodiment, a second cutting knife 270 separate from the first cutting knife 240 can be movably connected to the frame 102. In the illustrated embodiment, the second cutting knife 270 is also a julienne cutting knife including an elongated bar 272 and a plurality of vertically standing julienne blades 274 attached to and extending upwardly from the bar 272. To connect the second cutting knife 270 to the frame 102, extending outwardly from opposite ends of the bar 272 are projections 280. The projections 280 are displaceable in elongated or slotted (in the vertical direction) openings 282 located on the inwardly facing surfaces 214 of the frame sides 108 adjacent the openings 252 (FIG. 3). To further position and secure the second cutting knife with respect to the runway 106, the bar 272 includes a boss 284 having a bore 286 extending therethrough. The bore is dimensioned to slidably receive a post 288 extending from a bottom surface of the runway 106 (FIG. 7). In a julienne position of the food slicer, at least one of the julienne blades 244, 274 of the first and second cutting knives 240, 270 project upwardly through respective openings 260 provided on the downstream end 166 of the runway 106. As the food bulk passes across the runway 106, vertical slices are made therein. Once the cutting blade 112 passes through the food bulk, the combination of the vertical slices made by at least one of the vertical blades 244, 274 and the horizontal cutting blade 112 creates julienne slices of the food bulk.

As indicated previously, the adjustment mechanism 110 is connected to the frame 102 and configured to adjust an offset between the cutting blade 112 and the runway 106. In the depicted embodiment of FIG. 2, the adjustment mechanism 110 includes a knob 300 operably connected to first and second movable guide members or cam plates 302, 304 provided on the opposed longitudinal sides 108 of the frame 102 and displaceable along a length of the frame 102 via a gear mechanism 306. The exemplary gear mechanism 306 includes first and second pinion gears 310, 312, a shaft 314 interconnecting the first and second pinion gears, and first and second racks 316, 318. The first and second pinion gears 310, 312 are housed in correspondingly shaped first and second frame sections 330, 332 of the frame sides 108. As depicted, each of the first and second pinion gears 310, 312 includes an axle 334, 336 that is received in a correspondingly shaped cutout 340, 342 provided in each of the first and second frame sections 330, 332. End portions 350, 352 of the shaft 314 are received in bores 354, 356 of the respective first and second pinion gears 310, 312, and are supported in openings 360 located on the inwardly facing surfaces 214 of the frame sides 108 (FIGS. 3 and 4). The knob 300 is connected to the shaft end portion 350 which extends outwardly from the first frame section 330.

Figure 5:
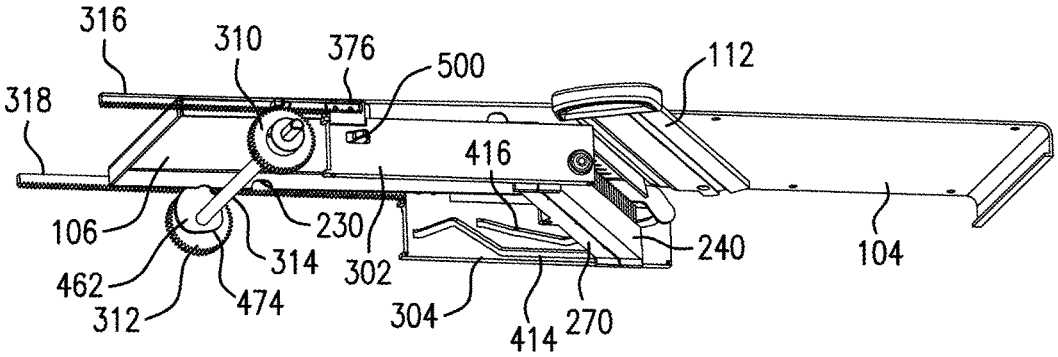
FIGS. 5 and 6 are side perspective views of an adjustment mechanism of the food slicer of FIG. 1.
Figure 6:
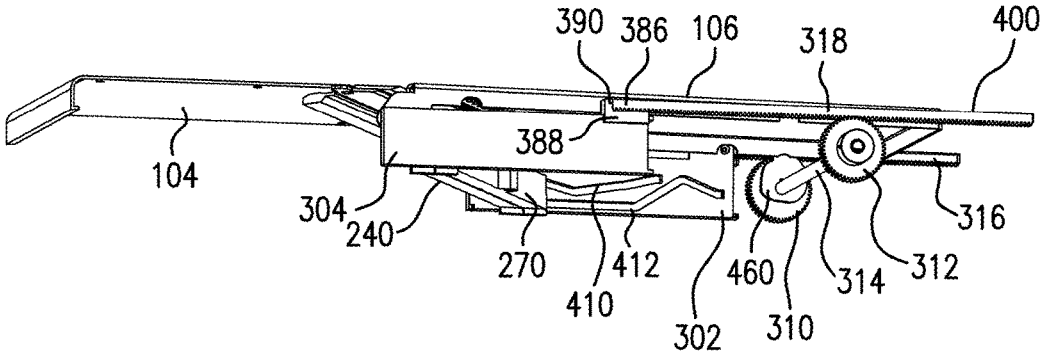

The first and second racks 316, 318, which can be of differing lengths, are operably engaged to the respective first and second pinion gears 310, 312 and to the respective first and second cam plates 302, 304. Particularly, the first rack 316 includes a first end portion 370 that is received in a seat 372 located on the first cam plate 302. As best depicted in FIG. 5, an inwardly facing mounting tab can be provided on the seat 372. The mounting tab can be fastened to the first end portion 370 via fasteners (not shown) extending through openings 376 in the tab. A second end portion 380 of the first rack 316 is engaged atop the first pinion gear 310. Similarly, the second rack 318 includes a first end portion 386 that is received in a seat 388 located on the second cam plate 304. As best depicted in FIGS. 2 and 6, an inwardly facing mounting tab 392 can be provided on the seat 388. The mounting tab can be fastened to the first end portion 386 via fasteners (not shown) extending through openings 396 in the tab. A second end portion 400 of the second rack 318 is engaged atop the second pinion gear 312. With the illustrated arrangement of the gear mechanism 306, rotation of the knob 300 in a first direction (e.g., clockwise in FIG. 1) rotates the first and second pinion gears 310, 312, and this rotation of the pinion gears 310, 312 moves the first and second racks 316, 318 in the longitudinal direction of the slicer 100. Because the first end portions 370, 386 of the respective first and second racks 316, 318 are connected to the respective first and second cam plates 302, 304, rotation of the knob 300 in the first direction also slides the first and second cam plates 302, 304 within the frame 102 toward the landing 104.

Figure 9:
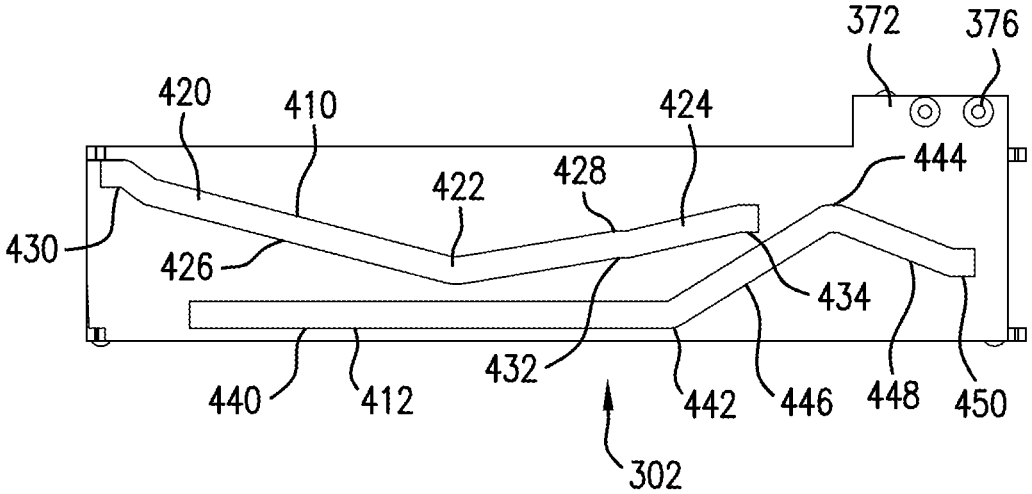
FIG. 9 is a side view of a cam plate of the adjustment mechanism of FIGS. 5 and 6.
Figure 10:
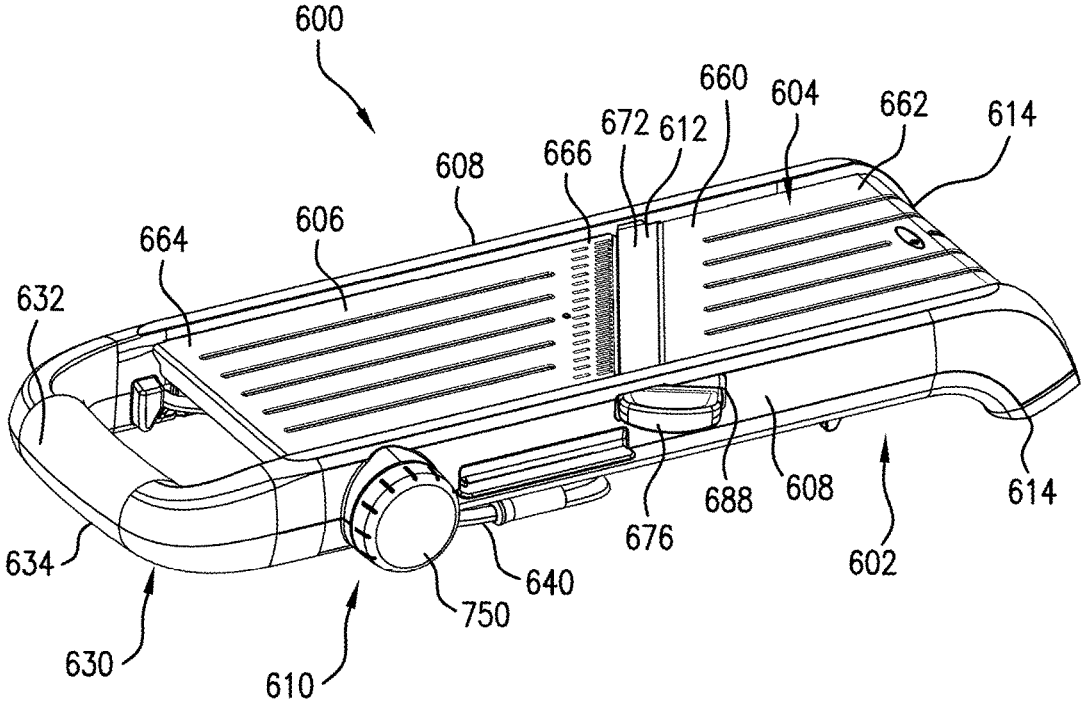
FIG. 10 is a side perspective view of an exemplary mandoline-type food slicer according to another aspect of the present disclosure.
Figure 11:
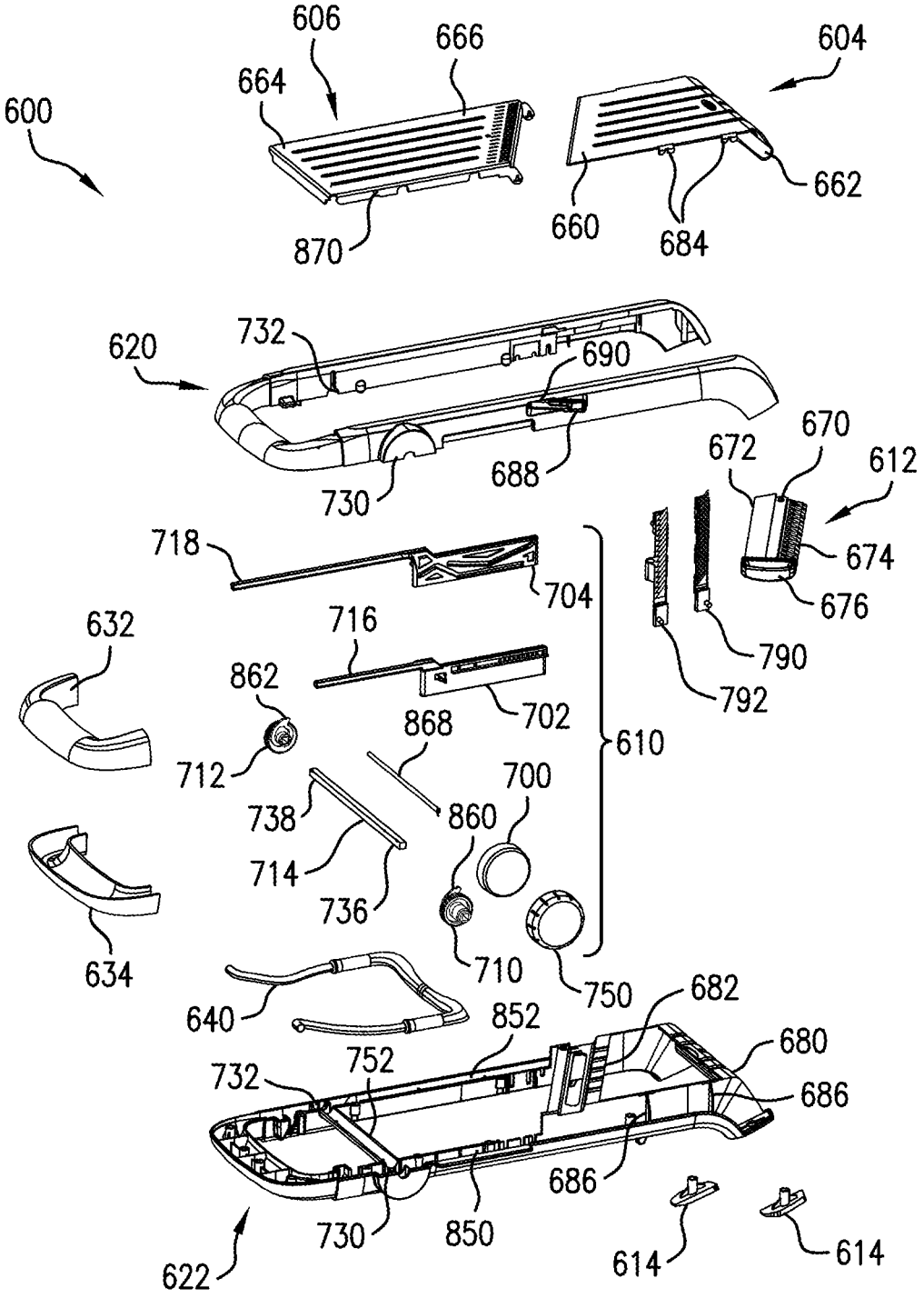
FIG. 11 is an exploded perspective view of the food slicer of FIG. 10.

As best depicted in FIG. 9, the first movable side member or cam plate 302 includes spaced apart first and second guide tracks 410, 412. Similarly, as shown in FIG. 5, the second movable side member or cam plate 304 includes spaced apart first and second guide tracks 414, 416. The adjustment mechanism 110 simultaneously engages the runway 106 and each of the first cutting knife 240 and second cutting knife 270 with the first guide tracks 410, 414 cooperating with the downstream end 166 of the runway 106 and the second guide tracks 412, 416 cooperating with the first and second cutting knives 240, 270. With this arrangement, rotation of the knob 300 in the first direction moves or lowers the runway 106 relative to the cutting blade 112 to adjust a cutting thickness, and continued rotation of the knob 300 in the first direction raises each of the second cutting knife 270 and the first cutting knife 240 in that order to their respective working, julienne position.

The first guide track 410 of the first movable cam plate 302 includes a downstream section 420, a central section 422 and an upstream section 424, and defines a first sloping surface 426 between the central section 422 and the downstream section 420 and a second sloping surface 428 between the central section 422 and the upstream section 424. As best depicted in FIG. 9, a first landing 430 is provided at the end of the downstream section 420, a second landing 432 is located along a length of the second sloping surface 428, and a third landing 434 is provided at the end of the upstream section 424. The second guide track 412 of the first movable cam plate 302 includes a downstream section 440, a central section 442 and an upstream section 444. The downstream section 440 extends substantially parallel to the longitudinal axis of the food slicer 100. As shown, the upstream section 444 includes a first sloping surface 446 sloped upwardly toward the first guide track 410, a second sloping surface 448 sloped downwardly away from the first guide track 410, and a landing 450 provided at the end of the upstream section 444. As best shown in FIGS. 2 and 5, the orientation of the first and second guide tracks 414, 416 provided on the second movable cam plate 304 is substantially a mirror image of the orientation of the first and second tracks 410, 412 provided on the first movable cam plate 302. Therefore, further discussion of the features of the first and second guide tracks 414, 416 of the second movable cam plate 304 is omitted for conciseness. To secure the first and second movable cam plates 302, 304 to the frame 102, the frame defines first and second channels 452, 454 configured to receive the first and second cam plates and allow for longitudinal displacement of the first and second cam plates 302, 304 upon actuation of the gear mechanism 306.

Figure 8:
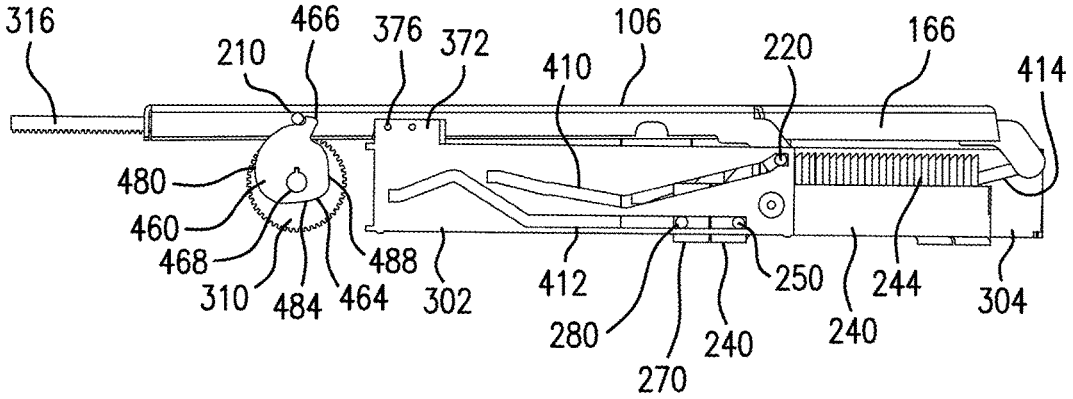
FIG. 8 is side view of the adjustment mechanism of FIGS. 5 and 6.

With reference to FIGS. 7 and 8, further included with the gear mechanism 306 are a first cam 460 and a second cam 462. The first cam 460 includes a guide surface 464, a stop 466 extending outwardly from the guide surface 464 and an opening 468 for receiving the shaft 314. The first cam 460 is located inwardly of the first pinion gear 310 (FIG. 4), and is positioned on the frame 102 such that the stop 466 is in contact with the projection 210 on the upstream end 164 of the runway 106 in the locked position of the slicer 100. Similarly, the second cam 462 includes a guide surface 474, a stop 476 extending outwardly from the guide surface 474 and an opening 478 for receiving the shaft 314. The second cam 462 is located inwardly of the second pinion gear 312 (FIG. 4), and is positioned on the frame 102 such that the stop 476 is in contact with the other projection 210 on the upstream end 164 of the runway 106 in the locked position of the slicer 100. As depicted, each of the guide surfaces 464, 474 of the first and second cams 460, 462 include a defined first section 480, 482, second section 484, 486 and third section 488, 490 which correspond to the downstream section, central section and upstream section of each first guide track 410, 414 of the first and second cam plates 302, 304. With the first and second cams 460, 462 secured on the shaft 314, rotation of the knob 300 in the first direction (e.g., clockwise in FIG. 1) rotates the first and second cams 460, 462 together with the first and second pinion gears 310, 312. As the first and second cams 460, 462 rotate the projections 210 of the runway 106 ride along the guide surfaces 464, 474, which, in turn, allows for vertical movement of the projections 210 in the openings 212 of the frame 102 and the lowering of the upstream end 164 of the runway 106.

As indicated above, the pair of projections 210 provided at the upstream end 164 of the runway 106 is movably received in the corresponding elongated openings 212 provided in the frame 102 via the first and second cams 460, 462. The pair of projections 220 provided at the downstream end 166 of the runway 106 is movably received in the corresponding elongated openings 224 provided in the frame 102 via the first and second movable cam plates 302, 304. Particularly, the projections 220 are slidably received in the first guide tracks 410, 414 of the respective first and second movable cam plates 302, 304. With the projections 210, 220 received in the respective openings 212, 224 provided in the sides 108 of the frame 102, longitudinal movement of the projections 210, 220 is precluded while vertical movement is allowed. The first cutting knife 240 includes the projections 250 slidably received in the frame openings 252, which precludes longitudinal movement and allows vertical movement, and also in the second guide tracks 412, 416 of the respective first and second movable cam plates 302, 304. The second cutting knife 270 includes the projections 280 slidably received in the frame openings 282, which precludes longitudinal movement and allows vertical movement, and also in the second guide tracks 412, 416 of the respective first and second movable cam plates 302, 304. The knob 300 allows the operator to select the offset between the runway 106 and the cutting blade 112. To adjust the thickness of a food slice, a user rotates the knob 300 in the first direction, which actuates the gear mechanism 306. As indicated above, rotation of the knob 300 rotates the first and second pinion gears 310, 312 which, in turn, move the first and second racks 316, 318 and the first and second cam plates 302, 304 connected to the first and second racks 316, 318. Sliding movement of the first and second cam plates 302, 304 in channels 452, 454 of the frame 102 via the gear mechanism 306 vertically moves the downstream end 166 of the runway 106. Further movement of the first and second cam plates 302, 304 raises the first and second cutting knives 240, 270 to their respective working julienne positions. Rotation of the knob 300 also rotates the first and second cams 460, 462 which support the projections 210 on the upstream end 164 of the runway 106. This allows the upstream end 164 of the runway 106 to vertically move simultaneously with the downstream end 166 of the runway 106.

More particularly, FIGS. 5 and 6 depict the first and second movable cam plates 302, 304 of the adjustment mechanism 110 in the locked position of the slicer 100. In the locked position, the surfaces of the runway 106, cutting blade 112 and landing 104 are substantially coplanar (i.e. there is no opening between the downstream end 166 of the runway and the edge of the cutting blade 112 for the passage of sliced food). In the locked position, the projections 220 of the runway 106 are located on the first landing provided at the end of the downstream section of each of the first guide tracks 410, 414 of the first and second cam plates 302, 304 (e.g., first landing 430 provided at the end of the downstream section 420 of the first guide track 410, see FIG. 9). The projections 250, 280 of the first and second cutting knives 240, 270 are located at the ends of the respective downstream sections of the second guide tracks 412, 416 of the first and second cam plates 302, 304 (e.g., the end of the downstream section 440 of the second guide track 412, see FIG. 9). In the locked position, the projections 210 at the upstream end 164 of the runway 106 abut the stops 466, 476 of the respective first and second cams 460, 462.

A first rotational movement of the knob 300 of the adjustment mechanism 110 rotates the first and second pinion gears 310, 312 which longitudinally displace the first and second racks 316, 318 and the first and second movable cam plates 302, 304 connected thereon. This displacement of the first and second cam plates 302, 304 moves the projections 220 on the downstream end 166 of the runway 106 from the downstream section of each of the first guide tracks 410, 414 along the first sloping surface (e.g., first sloping surface 426 of the first guide track 410) toward the central section (e.g., central section 422 of the first guide track 410). This movement also simultaneously moves the projections 250, 280 of the first and second cutting knives 240, 270 away from the downstream section and toward the central section of each second guide track 412, 416 (e.g., away from downstream section 440 toward central section 442 of second guide track 412). Further, the first and second cams 460, 462 rotate together with the first and second pinion gears 310, 312, the projections 210 on the upstream end 164 of the runway 106 riding on the first sections 480, 482 of the cam guide surfaces 464, 474. In this first position of the adjustment mechanism 110, the entirety of the runway 106 is vertically moved relative to the longitudinal axis of the slicer 100, and the downstream end 166 of the runway 106 is spaced from the edge of the cutting blade 112 and defines a first opening for the passage of sliced food.

Continued rotation of the knob 300 in the first direction further longitudinally displaces the first and second movable cam plates 302, 304. The projections 220 received in the first guide tracks 410, 414 of the first and second cam plates 302, 304 slide from the central sections and along the second sloping surfaces of the upstream sections (e.g., from the central section 422 toward the upstream section 424 along the second sloping surface 428 of the first guide track 410). And the projections 210 continue to move on the guide surfaces 464, 474 of the first and second cams 460, 462, now along the second sections 484, 486. This, in turn, begins to vertically raise the runway 106 from its lowermost position. Further, the projections 280 of the second cutting knife 270 located in the second guide tracks 412, 416 simultaneously move from the central sections and along the first sloping surfaces of the upstream sections (e.g., first sloping surface 446 of the upstream section 444 of the second guide track 412). This displaces the second cutting knife 270 upwardly toward the runway 106 and raises the julienne blades 274 through the openings 290 provided on the runway 106. Therefore, in this second position of the adjustment mechanism 110, the runway 106 is raised from its lowermost position and the second cutting knife 270 is in its cutting or working position relative to the runway 106.

Further rotation of the knob 300 in the first direction further longitudinally displaces the first and second movable cam plates 302, 304. The projections 220 received in the first guide tracks 410, 414 of the first and second cam plates 302, 304 slide further along the second sloping surfaces of the upstream sections. The projections 210 continue to move on the guide surfaces 464, 474 of the first and second cams 460, 462, now along the third sections 488, 490. This continues to vertically raise the runway 106 within the frame 102. The projections 280 of the second cutting knife 270 located in the second guide tracks 412, 416 simultaneously move from the first sloping surfaces and along the second sloping surfaces of the upstream sections (e.g., second sloping surface 448 of the upstream section 444 of the second guide track 412). This displaces the second cutting knife 270 downwardly away from the runway 106 and lowers the julienne blades 274. The projections 250 of the first cutting knife 240 located in the second guide tracks 412, 416 now move along the first sloping surfaces of the upstream sections (e.g., first sloping surface 446 of the upstream section 444 of the second guide track 412). This displaces the first cutting knife 240 upwardly toward the runway 106 and raises the julienne blades 244 through the openings 260 provided on the runway 106. Therefore, in this third position of the adjustment mechanism 110, the runway 106 is further raised and the first cutting knife 240 is in its cutting or working position relative to the runway 106.

It should be appreciated that as the runway 106 raises from the lowermost first position to the second and third positions, the spacing between the downstream end 166 of the runway 106 and the cutting blade 112 is decreased for the passage of sliced food. Rotation of the knob 300 in a second direction returns the slicer 100 back into its locked position. In addition, the slicer 100 is further provided with a visual indicator 500 of the working positions of the adjustment mechanism 110. In the depicted embodiment, the indicator 500 projects from the first cam plate 302 and through a slot 502 extending along one of the sides 108 of the frame 102.

FIGS. 10-13 illustrate an exemplary mandoline-type food slicer 600 according to another aspect of the present disclosure for slicing food advanced in a downstream cutting direction. Similar to the food slicer 100, the food slicer 600 includes a frame 602 for supporting an outfeed deck or landing 604 and an infeed deck or runway 606 between longitudinal sides 608 of the frame. The runway 606 is movable relative to the landing 604 by an adjustment mechanism 610 so that a thickness of a slice of food made by the food slicer 600 can be selected. A cutting blade 612 is secured to the landing 604. Feet 614 having a non-slip surface are mounted to the frame 602. As shown, the frame 602 includes an upper frame part 620 and a lower frame part 622 secured to the upper part 620 by a plurality of fasteners, such as screws (not shown). The upper and lower parts 620, 622 of the frame 602 also define a handle 630, which can be provided with upper and lower grips 632, 634 overmolded onto the respective upper and lower frame parts 620, 622, for ease of transport as well as for steadying the food slicer 600 during use. Additionally, a stand 640 can be pivotally connected to the lower frame part 622 of the frame 602 so that the frame can be raised during use of the food slicer 600. The landing 604 includes an upstream end 660 and a downstream end 662, which can be at least partially curled inwardly to follow a contour of the frame 602. Similarly, the runway 606 includes an upstream end 664 and a downstream end 666. The blade 612 is secured on a top side of the upstream end 660 of the landing 604. The downstream end 666 of the runway 606 is spaced or offset from the edge of the cutting blade 612 to define an opening for the passage of sliced food bulk.

The cutting blade 612 includes a body 670 having a first blade part 672 extending along one side and a second blade part 674 extending along an opposite side of the body 670. Like the cutting blade 112 described above, the first blade part 672 is defined by a single substantially planar member which is substantially co-planar with a top surface of the landing 604. However, the second blade part 674 is defined by a waffle-type blade. Again, the cutting blade 612 is configured such that one of the first blade part 672 and second blade part 674 is positioned on the slicer 600 for cutting, and depending on the selected first or second blade part, a handle 676 is secured to one of the ends of the body 670. Differing from the frame 102 of the slicer 100, the lower part 622 of the frame 602 includes a first support 680 and a second support 682. The landing 604 is supported by the first and second supports 680, 682 and is properly positioned on the lower frame part 622 via notched tabs 684 which engage ribs 686 provided on the lower frame part 622. The cutting blade 612 is positioned on the second support 682 via a guide member 688 extending through a slot 690 located on one of the side 608 of the frame 602. The body 670 of the cutting blade 612 is slidingly received in the guide member 688 and is supported by the second support 682.

As indicated previously, the adjustment mechanism 610 is connected to the frame 602 and configured to adjust an offset between the cutting blade 612 and the runway 106. In the depicted embodiment of FIGS. 11-13, the adjustment mechanism 610 includes a knob 700 operably connected to first and second movable guide members or cam plates 702, 704 provided on the opposed longitudinal sides 608 of the frame 602 and displaceable along a length of the frame 602 via a gear mechanism 706. The exemplary gear mechanism 706 is similar to the gear mechanism 306 and includes first and second pinion gears 710, 712, a shaft 714 interconnecting the first and second pinion gears, and first and second racks 716, 718. The first and second pinion gears 710, 712 are housed in correspondingly shaped first and second sections 730, 732 of the frame sides 608. As depicted, the shaft 714, which can be rectangular shaped, has end portions 736, 738 received in axles 740, 742 of the respective first and second pinion gears 710, 712. The knob 700 is connected to the shaft end portion 766 which extends outwardly from the side 608 of the frame 602, and a grip 750 can be secured to the knob 700. Further, the shaft 714 is protected (and at least partially concealed by) a shield member 752 located on the lower frame part 622.

The first and second racks 716, 718, which again can be of differing lengths, are operably engaged to the respective first and second pinion gears 710, 712 and to the respective first and second cam plates 702, 704. Particularly, and unlike the gear mechanism 306 where the first and second racks 316, 318 are separate components, the first and second racks 716, 718 of the gear mechanism 706 are integral with the respective first and second cam plates 702, 704. With the illustrated arrangement of the gear mechanism 706, rotation of the knob 700 in a first direction (e.g., clockwise in FIG. 10) rotates the first and second pinion gears 710, 712, and this rotation of the pinion gears 710, 712 moves the first and second racks 716, 718 in the longitudinal direction of the slicer 600. Because the respective first and second racks 716, 718 are integral with the respective first and second cam plates 702, 704, rotation of the knob 700 in the first direction also slides the first and second cam plates 702, 704 within the frame sides 608 toward the landing 604.

Figure 12:
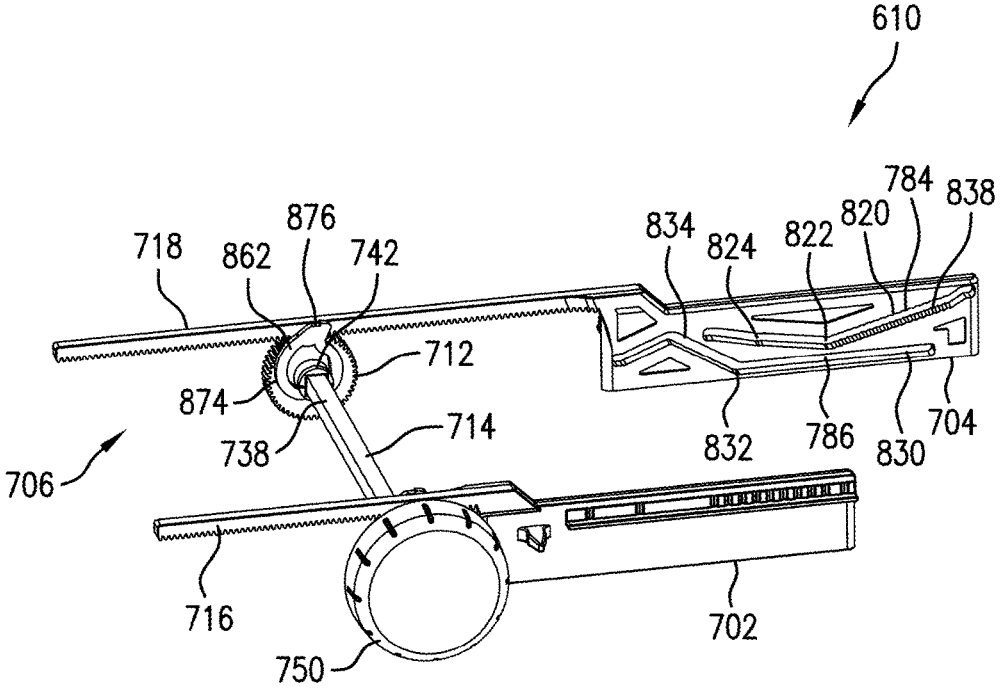
FIGS. 12 and 13 are side perspective views of an adjustment mechanism of the food slicer of FIG. 10.
Figure 13:
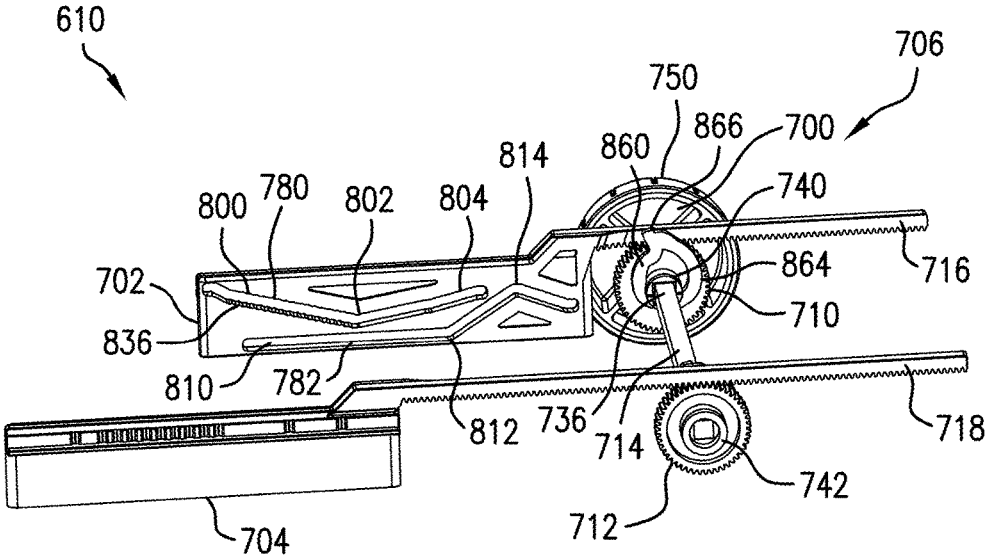

The first and second cam plates 702, 704 are configured similar to the first and second cam plates 302, 304, and therefore, a detailed description of the features of the first and second cam plates 702, 704 will be omitted for conciseness. As best depicted in FIGS. 12 and 13, the first cam plate 702 includes spaced apart first and second guide tracks 780, 782, and the second cam plate 704 includes spaced apart first and second guide tracks 784, 786. The adjustment mechanism 610 simultaneously engages the runway 606 and each of a first cutting knife 790 and second cutting knife 792 (which are configured similar to the first and second cutting knives 240, 270) with the first guide tracks 780, 784 cooperating with the downstream end 666 of the runway 606 and the second guide tracks 782, 786 cooperating with the first and second cutting knifes 790, 792. With this arrangement, rotation of the knob 700 in the first direction moves or lowers the runway 606 relative to the cutting blade 612 to adjust a cutting thickness, and continued rotation of the knob 700 in the first direction raises each of the second cutting knife 792 and the first cutting knife 790 in that order to their respective working, julienne position.

As best depicted in FIGS. 12 and 13, the first guide track 780 of the first cam plate 702 includes a downstream section 800, a central section 802 and an upstream section 804. The second guide track 782 of the first cam plate 702 includes a downstream section 810, a central section 812 and an upstream section 814. As stated above, the orientation of the first and second guide tracks 784, 786 provided on the second cam plate 704 is substantially a mirror image of the orientation of the first and second tracks 780, 782 provided on the first cam plate 702. Therefore, the first guide track 784 of the second cam plate 704 includes a downstream section 820, a central section 822 and an upstream section 824. And the second guide track 786 of the second cam plate 704 includes a downstream section 830, a central section 832 and an upstream section 834. In the depicted aspect, the downstream sections 800, 820 of the respective first guide tracks 780, 784 can includes steps 836, 838 which allow for incremental adjustment of the height of the landing 604 relative to the runway 606. To secure the first and second movable cam plates 702, 704 to the frame 602, the frame defines first and second channels 850, 852 configured to receive the first and second cam plates and allow for longitudinal displacement of the first and second cam plates 702, 704 upon actuation of the gear mechanism 706.

Further included with the gear mechanism 706 are a first cam 860 and a second cam 862. The first cam 860 includes a guide surface 864 and a stop 866 extending outwardly from the guide surface 864. The first cam 860 is located inwardly of the first pinion gear 710, and is positioned on the frame 602 such that the stop 866 is in contact with a pin 868 secured in openings 870 on the runway 606 in the locked position of the food slicer 600. Similarly, the second cam 862 includes a guide surface 874 and a stop 876 extending outwardly from the guide surface 874. The second cam 862 is located inwardly of the second pinion gear 712, and is positioned on the frame 602 such that the stop 876 is in contact with the pin 868 in the locked position of the slicer 600. In the depicted aspect of the gear mechanism 706, the first and second cams 860, 862 are integral with respective first and second pinion gears 710, 712. Like to the first and second cams 460, 462, each of the guide surfaces 864, 874 of the first and second cams 860, 862 include a defined sections which correspond to the downstream section, central section and upstream section of each first guide track 780, 784 of the first and second cam plates 702, 704. As described above, rotation of the knob 700 in the first direction (e.g., clockwise in FIG. 10) rotates the first and second cams 860, 862 together with the first and second pinion gears 710, 712. As the first and second cams 860, 862 rotate the pin 868 secured to and beneath the runway 606 ride along the guide surfaces 864, 874, which, in turn, allows for vertical movement (i.e., lowering) of the upstream end 664 of the runway 606.

The knob 700 allows the operator to select the offset between the runway 606 and the cutting blade 612. To adjust the thickness of a food slice, a user rotates the knob 700 in the first direction, which actuates the gear mechanism 706. As indicated above, rotation of the knob 700 rotates the first and second pinion gears 710, 712 which, in turn, move the first and second racks 716, 718 and the first and second cam plates 702, 704. Sliding movement of the first and second cam plates 702, 704 in the frame 602 via the gear mechanism 706 vertically moves the downstream end 666 of the runway 606. Further movement of the first and second cam plates 702, 04 raises the first and second cutting knives 790, 792 to their respective working julienne positions. Rotation of the knob 700 also rotates the first and second cams 860, 862 which support the pin 868 on the upstream end 664 of the runway 606. This allows the upstream end 664 of the runway 606 to vertically move simultaneously with the downstream end 666 of the runway 606. Because the operation of the food slicer 600 is basically the same as that of the food slicer 100, further description will be omitted for conciseness.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claim.

What is claimed is:

1. A mandoline-type food slicer for slicing food advanced in a cutting direction, the food slicer comprising:

a frame for supporting a landing and a runway, which is movable relative to the landing;

a cutting blade secured on an upstream end of the landing, a downstream end of the runway being spaced from an edge of the cutting blade to define an opening for the passage of sliced food;

a separate cutting knife moveably connected to the frame; and an adjustment mechanism connected to the frame and configured to adjust an offset between the cutting blade and the runway, the adjustment mechanism including:

spaced apart first and second guide tracks provided on respective first and second cam plates, and a gear mechanism for moving the first and second cam plates along a length direction of the food slicer, wherein the adjustment mechanism simultaneously engages the runway and the cutting knife, the first guide tracks cooperating with the downstream end of the runway and the second guide tracks cooperating with the cutting knife, wherein the first and second guide tracks are configured such that a first movement of the adjustment mechanism from a locked position of the food slicer to a cutting position lowers the downstream end of the runway relative to the cutting blade to adjust a cutting thickness and a second movement of the adjustment mechanism from the cutting position raises the cutting knife to a working position.

2. The food slicer of claim 1, wherein the gear mechanism includes a first pinion gear meshingly engaged to a first rack connected to the first cam plate.

3. The food slicer of claim 2, wherein the gear mechanism includes a second pinion gear meshingly engaged to a second rack connected to the second cam plate.

4. The food slicer of claim 3, wherein the first and second racks are integral with the respective first and second cam plates.

5. The food slicer of claim 3, further including a shaft interconnecting the first and second pinions gears and a knob connected to an end portion of the shaft extending outwardly from the frame.

6. The food slicer of claim 1, wherein the gear mechanism is configured such that the first movement of the adjustment mechanism simultaneously lowers the upstream end of the runway.

7. The food slicer of claim 6, wherein the gear mechanism includes a first cam engaging the upstream end of the runway, wherein rotation of the first cam lowers the upstream end of the runway.

8. The food slicer of claim 7, wherein the gear mechanism further includes a second cam engaging the upstream end of the runway.

9. The food slicer of claim 8, wherein the first and second cams include respective first and second guide surfaces and the upstream end of the runway includes one of laterally spaced projections and a pin engaging the first and second guide surfaces.

10. The food slicer of claim 9, wherein the frame includes elongated openings cooperating with the projections on the upstream end of the runway.

11. The food slicer of claim 1, wherein the first guide track of the first cam plate includes an upstream section, a central section and a downstream section, and defines a first upward sloping surface from the central section toward the upstream section and a second upward sloping surface from the central section toward the downstream section, wherein the first movement of the adjustment mechanism moves the downstream end of the runway along the first sloping surface from the downstream section toward the central section and the second movement of the adjustment mechanism moves the downstream end of the runway along the second sloping surface from the central section toward the upstream section, and wherein the runway is at its lowermost position in the central section.

12. The food slicer of claim 11, wherein the second guide track of the first cam plate includes a downstream section and an upstream section which is sloped relative to the downstream section, wherein the second movement of the adjustment mechanism moves the cutting knife along the upstream section to the working position.

13. The food slicer of claim 12, wherein the upstream section of the second guide track includes a first sloping surface slope upward toward the first guide track and a second sloping surface sloped downwardly away from the first guide track, wherein the cutting knife is a first cutting knife and further including a second cutting knife cooperating with the second guide tracks of the first and second cam plates, and when the second cutting knife is in the working position the first cutting knife is positioned along the second sloping surface.

14. The food slicer of claim 12, wherein the orientation of the first and second guide tracks provided on the second cam plate is substantially a mirror image of the orientation of the first and second tracks provided on the first cam plate.

15. A mandoline-type food slicer for slicing food advanced in a cutting direction, the food slicer comprising:

a frame for supporting a landing and a runway, which is movable relative to the landing;

a cutting blade secured on an upstream end of the landing, a downstream end of the runway being spaced from an edge of the cutting blade to define an opening for the passage of sliced food;

a separate cutting knife moveably connected to the frame; and an adjustment mechanism connected to the frame and configured to adjust an offset between the cutting blade and the runway, the adjustment mechanism including:

spaced apart first and second guide tracks provided on respective first and second cam plates, the first guide tracks cooperating with the downstream end of the runway and the second guide tracks cooperating with the cutting knife, and a gear mechanism for moving the first and second cam plates along a length direction of the food slicer, the gear mechanism including:

a first pinion gear meshingly engaged to a first rack connected to the first cam plate, a second pinion gear meshingly engaged to a second rack connected to the second cam plate, a shaft interconnecting the first and second pinions gears, first cam associated with the first pinion gear, and a second cam associated with the second pinion gear.

16. The food slicer of claim 15, wherein the adjustment mechanism simultaneously engages the runway and the cutting knife, and wherein the first and second guide tracks are configured such that a first movement of the adjustment mechanism from a locked position of the food slicer to a cutting position lowers the downstream end of the runway relative to the cutting blade to adjust a cutting thickness and a second movement of the adjustment mechanism from the cutting position raises the cutting knife to a working position.

17. The food slicer of claim 16, wherein the gear mechanism is configured such that the first movement of the adjustment mechanism simultaneously lowers the upstream end of the runway.

18. The food slicer of claim 17, wherein the first and second cams engage the upstream end of the runway, wherein rotation of the first and second cams lowers the upstream end of the runway.

19. The food slicer of claim 17, wherein the first and second racks are integral with the respective first and second cam plates, and the first and second cams are integral with the respective first and second pinion gears.

20. The food slicer of claim 16, wherein the first guide track of the first cam plate includes an upstream section, a central section and a downstream section, and defines a first upward sloping surface from the central section toward the upstream section and a second upward sloping surface from the central section toward the downstream section, wherein the first movement of the adjustment mechanism moves the downstream end of the runway along the first sloping surface from the downstream section toward the central section and the second movement of the adjustment mechanism moves the downstream end of the runway along the second sloping surface from the central section toward the upstream section, and wherein the second guide track of the first cam plate includes a downstream section and an upstream section which is sloped relative to the downstream section, wherein the second movement of the adjustment mechanism moves the cutting knife along the upstream section to the working position.

* * * * *